United States Patent [19]

Ibata et al.

[11] Patent Number: 4,648,915

[45] Date of Patent: Mar. 10, 1987

[54] PERMANENT MN-AL-C ALLOY MAGNETS

[75] Inventors: Akihiko Ibata, Izumisano; Yoichi Sakamoto, Suita, both of Japan

[73] Assignee: Matsushita Electric Industrial Company, Ltd., Japan

[21] Appl. No.: 784,661

[22] Filed: Sep. 30, 1985

Related U.S. Application Data

[63] Continuation of Ser. No. 486,242, Apr. 18, 1983, Pat. No. 4,579,607.

[30] Foreign Application Priority Data

| | | | |
|---|---|---|---|
| Apr. 19, 1982 | [JP] | Japan | 57-65908 |
| Apr. 19, 1982 | [JP] | Japan | 57-65909 |
| Apr. 19, 1982 | [JP] | Japan | 57-65910 |
| Apr. 27, 1982 | [JP] | Japan | 57-72056 |
| May 26, 1982 | [JP] | Japan | 57-89144 |

[51] Int. Cl.[4] ..... H01F 1/02

[52] U.S. Cl. ..... 148/101; 148/120; 148/314

[58] Field of Search ..... 148/31.57, 100, 101, 148/102, 120, 121

[56] References Cited

U.S. PATENT DOCUMENTS

| | | | |
|---|---|---|---|
| 3,266,954 | 8/1966 | Hokkeling et al. | 148/31.57 |
| 3,944,445 | 3/1976 | Ohtani et al. | 148/121 |
| 4,023,991 | 5/1977 | Kubo et al. | 148/120 |
| 4,042,429 | 8/1977 | Kojima et al. | 148/31.55 |
| 4,051,706 | 10/1977 | Sakamoto et al. | 148/120 |
| 4,055,732 | 10/1977 | Yoshimura et al. | 148/120 |
| 4,133,703 | 1/1979 | Kojima et al. | 148/31.57 |
| 4,158,582 | 6/1979 | Krause | 148/120 |
| 4,404,046 | 9/1983 | Sakamoto et al. | 148/101 |

FOREIGN PATENT DOCUMENTS

| | | |
|---|---|---|
| 0016960 | 10/1980 | European Pat. Off. . |
| 0092422 | 10/1983 | European Pat. Off. . |
| 1482489 | 10/1977 | United Kingdom . |

OTHER PUBLICATIONS

Chemical Abs. vol. 84, No. 20, May 17, 1976, p. 602, No. 143988yh.

Abdelnour et al., "Permanent Magnet Properties of Mn-Al-C Between −50° C. and 150° C.," IEEE Trans. on Magnetics, vol. MAG-17, No. 6, Nov. 1981, pp. 2651-2653.

Kubo et al., "Anisotropic Mn-Al-C Alloy Permanent Magnets can be Machined and Mass Produced" JEE J. E. Eng, No. 127, Jul. 1977, pp. 50-54.

*Primary Examiner*—John P. Sheehan

*Attorney, Agent, or Firm*—Lowe, Price, Leblanc, Becker & Shur

[57] ABSTRACT

A billet made of a polycrystalline Mn-Al-C alloy magnet which is obtained by plastically deforming a Mn-Al-C alloy for magnet such as by extrusion at a temperature of 530° to 830° C. is used for compressive working. When the billet is hollow, it is entirely or locally compressed along the axis of the hollow billet. On the other hand, when the billet is solid, an outer circumferential portion of the billet is compressed. By the compression, the anisotropic structure of the portion where compressed is changed into an anisotropic structure having a direction of easy magnetization in radial directions. The magnet obtained by the method is also disclosed. The magnet has a radially anisotropic structure or novel structures having two different types of anisotropies therein.

14 Claims, 19 Drawing Figures

PERMANENT MN-AL-C ALLOY MAGNETS

This is a continuation of application Ser. No. 486,242 filed Apr. 18, 1983, now U.S. Pat. No. 4,579,607.

BACKGROUND OF THE INVENTION

1. Field of the Invention

This invention relates to permanent magnets and more particularly, to polycrystalline Mn-Al-C ally magnets of high performance suitable for use in multipolar magnetization. Also, it relates to a method for making the magnets of the just-mentioned type.

2. Description of the Prior Art

Mn-Al-C alloy magnets have mainly the ferromagnetic face-centered tetragonal phase structure ($\tau$ phase L1o type superstructure) and comprises carbon as their essential component element. The Mn-Al-C alloy magnets include those magnets of the ternary alloys free of any additive elements except for inevitable impurities and quaternary or multicomponent alloys which contain small amounts of additive elements. By the term "Mn-Al-C alloy magnet" used herein are meant magnets of the alloys including quaternary or multicomponent alloys as well as the ternary alloys.

Known methods of making Mn-Al-C alloy magnets include, aside from those methods using casting and heat treatments, a method which comprises a warm plastic working process such as warm extrusion. The latter method is known as a method of making an anisotropic magnet which has excellent properties such as high magnetic characteristics, mechanical strength and machinability.

On the other hand, Mn-Al-C alloy magnets for multipolar magnetization can be made by several methods including a method using isotropic magnets or compressive working, and a method in which a uniaxially anisotropic polycrystalline Mn-Al-C alloy magnet obtained by a known technique such as warm extrusion is subjected to warm free compressive working in a direction of easy magnetization, i.e. a compound working method.

However, the compressive working method involves the drawbacks that although high magnetic characteristics are obtained in radial directions, a relatively high reduction rate is necessary, non-uniform deformation may take place, and occurrence of a dead zone is unavoidable. According to the compound working method, there can be obtained magnets which exhibit high magnetic characteristics in all the directions within a plane including radial and tangential directions in small compressive strains. The magnets obtained by the compound working method have such a structure that the direction of easy magnetization is parallel to a specific plane, and they are magnetically isotropic within the plane and are anisotropic within a plane including a perpendicular with respect to the first-mentioned plane and a straight line parallel to the first-mentioned plane. These magnets are hereinafter referred to as plane-anisotropic permanent magnet.

Magnets for multipolar magnetization are generally in the form of a hollow cylinder and are magnetized as particularly shown in FIGS. 1 through 3 in which magnetic paths are indicated by broken lines. FIG. 1 is a schematic diagram of magnetic paths in a magnet body in case where a hollow cylindrical magnet undergoes multipolar magnetization in radial directions. FIG. 2 shows a case where a hollow cylindrical magnet is multipolarly magnetized around the outer circumferential surface and FIG. 3 shows a case of multipolar magnetization around the inner circumferential surface of a cylindrical magnet. The magnetization shown in FIG. 1 is called radial magnetization throughout the specification. Similarly, those magnetizations shown in FIGS. 2 and 3 are called outer lateral or circumferential magnetization and inner lateral or circumferential magnetization. In FIG. 2, radial directions are indicated by r and a tangential direction with respect to one radial direction is indicated by $\theta$.

As shown in FIG. 1, with the radial magnetization, the magnetic paths substantially run along the radial directions and thus the structure of the above-mentioned plane-anisotropic permanent magnet may not necessarily be proper. On the other hand, according to the compressive working technique, high magnetic characteristics along radial directions can be obtained. However, as described before, this working technique involves the problems that a relatively high reduction rate is required, non-uniform deformation may occur and occurrence of a dead zone is unavoidable.

Plane-anisotropic permanent magnets are magnets of versatile utility which exhibit excellent magnetic characteristics when magnetized in the manners shown in FIGS. 1 through 3. In this connection, however, if consideration is given, for example, to the outer circumferential magnetization, the plane-anistropic permanent magnet has not necessarily a favorable anisotropic structure at its outer or inner circumferential portion. With regard to the outer circumferential portion of a magnet body, it should favorably have higher magnetic charcteristics in radial directions than in tangential directions. On the other hand, so far as an inner circumferential portion is concerned, an anisotropic structure having higher magnetic characteristics in tangential directions than in radial directions is more suitable for outer circumferential magnetization. It will be noted that the outer circumferential portion of a magnet body means a portion where magnetic paths run substantially along radial directions and the inner circumferential portion means a portion where the magnetic paths run substantially along tangential directions, as particularly seen in FIG. 2.

SUMMARY OF THE INVENTION

It is accordingly an object of the present invention to provide a method for making Mn-Al-C alloy magnets having different types of anisotropic structures suitable for multipolar magnetization.

It is another object of the invention to provide a method for making anisotropic Mn-Al-C alloy magnets suitable for multipolar magnetization by compressing billets made of polycrystalline Mn-Al-C alloy magnets along the axis of the billets so that the billets are plastically deformed partially or entirely in section of the billet.

It is a further object of the invention to provide anisotropic Mn-Al-C alloy magnets suitable for multipolar magnetization obtained by the just-mentioned method.

The above objects can be achieved, according to the present invention, by a method which comprises providing a billet made of a polycrystalline Mn-Al-C alloy magnet which is rendered anisotropic and subjecting the billet to compressive working along the axis of the billet at a temperature ranging from 530° C. to 830° C. so that the billet is plastically deformed uniformly in radial directions.

The billet is preferably in the form of a cylinder which may be hollow or solid. The cylindrical billet may be compressed entirely or locally along the inner or outer circumferential portion of the cylinder. Polycrystalline Mn-Al-C alloy magnets which are rendered anisotropic can be obtained by subjecting known Mn-Al-C alloys for magnet to known hot plastic working at temperatures ranging from 530° to 830° C. It will be noted that Mn-Al-C alloys usable in the practice of the invention include Mn-Al-C ternary alloys which are free of any additive elements and quaternary or multicomponent alloys which contain, aside from Mn, Al and C, small amounts of additive elements such as Ni, Ti and the like.

Further, magnets may be compressed at the inner or outer circumferential portion thereof to impart an anisotropic structure different from the non-compressed portion. These magnets have two different types of anisotropies in the body which are hitherto unknown.

DETAILED DESCRIPTION AND EMBODIMENTS OF THE INVENTION

Known anisotropic magnets can be classified into three groups including a uniaxially anisotropic magnet which has high magnetic characteristics in one direction, a radially anisotropic magnet used in the field of multipolar magnetization, and the afore-mentioned plane-anisotropic magnet. The above three types of anisotropic structures are illustrated using a hollow cylindrical magnet. With uniaxially anisotropic magnets, a hollow cylindrical magnet has a direction of easy magnetization along its axis in which the direction of easy magnetization is parallel to the axis of the cylinder in any portions in the magnet.

Radially anisotropic magnets have the direction of easy magnetization parallel to radial directions of the cylinder in which the direction of easy magnetization is parallel to a radius of the hollow cylinder in any portions of the magnet.

Plane-anisotropic magnets have the direction of easy magnetization parallel to a plane vertical with respect to the axis of a hollow cylindrical magnet. The direction is not subject to preferred orientation in one direction within the plane, so that the magnet is magnetically isotropic within the plane. Any portions within the magnet have such a structure as described above.

Figure 1:
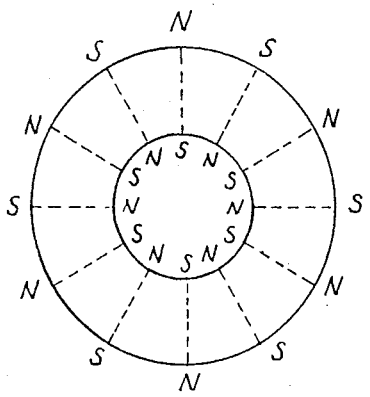
FIG. 1 is a schematic view showing magnetic paths formed within a hollow cylindrical magnet which is multipolarly magnetized in radial directions.
Figure 2:
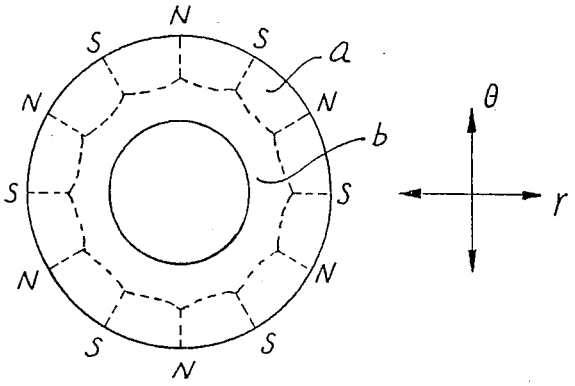
FIG. 2 is a schematic view showing magnetic paths formed within a a hollow cylindrical magnet body which is multipolarly magnetized on the outer circumference thereof.
Figure 3:
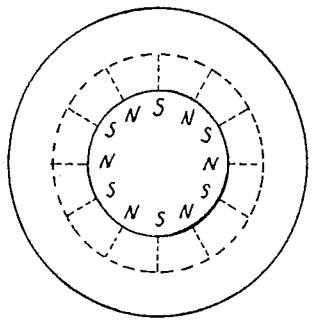
FIG. 3 is a schematic view showing magnetic paths formed within a hollow cylindrical magnet body which is multipolarly magnetized on the inner circumference thereof.

Multipolar magnetization can broadly be divided into three groups as particularly shown in FIGS. 1 through 3. A suitable anisotropic structure depends on the type of multipolar magnetization. For multipolar magnetization in radial directions shown in FIG. 1, magnets should preferably have a radially anisotropic structure. For the multipolar magnetization along the outer circumference shown in FIG. 2, the following three combinations were found to be suitable.

(1) The outer circumferential portion of a cylindrical magnet is radially anisotropic and the inner circumferential portion is tangentially anisotropic.

(2) The outer circumferential portion is radially anisotropic and the inner circumferential portion is plane-anisotropic.

(3) The outer circumferential portion is plane-anisotropic and the inner circumferential portion is tangentially anisotropic.

With the inner cirdcumferential magnetization shown in FIG. 3, three combinations of anisotropic structures are considered suitable similar to the case of the outer circumferential magnetization but the anisotropic structures at the outer and inner circumferential portions are reversed. In FIG. 3, for example, the outer circumferential portion means a portion in which magnetic paths are formed substantially along tangential directions. On the other hand, the inner circumferential portion means a portion in which magnetic paths run substantially along radial directions.

According to one aspect of the invention, there is obtained a radially anisotropic permanent magnet by a method which comprises subjecting a hollow cylindrical billet of a polycrystalline Mn-Al-C alloy magnet, which is rendered anisotropic, to compressive working along the axis of the billet at a temperature of 530° to 830° C. so that the billet is plastically deformed uniformly in radial directions. This magnet is suitably used for multipolar magnetization in radial directions.

According to another aspect of the invention, there are obtained permanent magnets which have novel anisotropic structures as will not be experienced in hitherto known anisotropic magnets.

Three novel types of anisotropic structures, for example, suitable for outer circumferential magnetization shown in FIG. 2 are illustrated using a magnet of a cylindrical form.

That is, a permanent magnet suitable for the outer circumferential magnetization obtained in accordance with the present invention has not the same anisotropic structure throughout the magnet. For instance, the magnet has broadly two portions, i.e. outer and inner circumferential portions a, b, and incudes two types of anisotropic structures in one magnet.

In other words, the outer circumferential portion is rendered radially anisotropic or plane-anisotropic and the inner circumferential portion is rendered tangentially anisotropic or plane-anisotropic provided that both the outer and inner portions are not plane-anisotropic at the same time.

As described before, this type of magnet can be divided into three classes including: a first class in which the outer circumferential portion of the magnet is radially anisotropic and the inner circumferential portion is tangentially anisotropic; a second class in which the outer circumferential portion is radially anisotropic and the inner circumferential portion is plane-anisotropic; and a third class in which the outer circumferential portion is plane-anisotropic and the inner circumferential portion is tangentially anisotropic. By the term "tangentially anisotropic" (i.e. anisotropy in $\theta$ direction) is meant an anisotropic structure similar to the radial anisotropy, in which when a magnet is in the form of a hollow cylinder, directions of easy magnetization are parallel to tangential directions (i.e. $\theta$ directions) of the cylinder in any portions within the magnet. In other words, the magnet is easily magnetized along tangential directions of the circumference.

It was described before that two different types of anisotropic structures exist in one magnet. This may be considered as follows: at least one of the outer and inner circumferential portions on the magnetically isotropic plane of a plane-anisotropic magnet has a magnetically anisotropic structure provided that the magnet is rendered radially anisotropic at the outer portion or is rendered tangentially anisotropic at the inner portion. For instance, with the first class, the outer circumferential portion is radially anisotropic and the inner circumferential portion is tangentially anisotropic.

When this type of magnet is subjected to the multipolar magnetization along the outer circumference as shown in FIG. 2, it exhibits more excellent magnetic characteristics than in the case of a mere plane-anisotropic magnet. This is considered as follow. The permanent magnet of the present invention having two different anisotropic structures therein has a structure whose [001] axes are arranged along magnetic paths in view of how the magnetic paths are formed in case where the multipolar magnetization is effected along the outer circumference as shown in FIG. 2. In this sense, plane anisotropy permits [001] axes to be equally arranged in directions different from the directions of the magnetic paths and may thus be considered to be a wasteful anisotropic structure.

In general, a preferred orientation of crystals in polycrystalline body is expressed by pole density P. The phase is tetragonal and the orientation of [001] axes can be taken as a distribution of (001) pole density. The (001) pole density in a given direction of polycrystalline body is determined as a ratio of an integral intensity of (00n) plane diffraction of the body to an integral intensity for isotropic body in case where the normal direction of X-ray diffraction is caused to coincide with the given direction. With isotropic magnets, the pole density in all three-dimensional directions is 1.

The permanent magnets obtained by the method of the invention have a pole density greater than 1 ($P>1$) in a specific direction parallel to a specific plane within the magnet and $P\leqq 1$ in a perpendicular direction of the plane.

With the first class, when the "within magnet" is assumed as the outer circumferential portion of a magnet, the specific direction is a radial direction (r direction). If the "within magnet" is considered as the inner circumferential portion, the specific direction is a tangential direction. For the second class, if the "within magnet" is taken as the outer circumferential portion of a magnet, the specific direction is a radial direction (r direction) similar to the first class and when taking as the inner portion of a magnet, the specific direction is an arbitrary direction. With the third class, the specific direction is an arbitrary direction when the "within magnet" means the outer circumferential portion of a magnet and is a tangential direction ($\theta$ direction) for the inner portion.

All permanent magnets made by us according to the invention had a difference in (001) pole density between a specific direction and a normal direction over 3:1. When the direction parallel to the plane is an arbitrary direction, a change of the (001) pole density is less than about 10%, which is within an ordinary accuracy in X-ray diffraction intensity measurements. If the direction is a specific direction, a ratio to a direction vertical to the specific direction exceeds 1.1:1. Larger ratios are more advantageous from the standpoint of magnetic characteristics.

The permanent magnets suitable for outer circumferential magnetization of the invention are considered as follows: plane-anisotropic magnets are subjected to preferred orientation in a specific direction at an outer and/or inner circumferential portion thereof within a plane of the plane-anisotropic magnet where [001] axes are equally arranged. From the standpoint of magnetic characteristics, it is a matter of choice as to whether the outer circumferential portion is rendered anisotropic radially or in r directions or the inner circumferential portion is rendered anisotropic tangentially or in $\theta$ directions. With the permanent magnets made by us, a ratio in residual magnetic flux density of a radially anisotropic magnet and a tangentially anisotropic magnet was found to exceed 1.1:1.

The anisotropic structures have been described in detail with regard to magnets suitable for outer circumferential magnetization. The three anisotropic structures suitable for inner circumferential magnetization are the same as those for outer circumferential magnetization except that the outer and inner portions are reversed with respect to the anisotropic structures.

Radially anisotropic magnets suitable for radial magnetization are obtained, according to the invention, only in small compressive strains imparted thereto without involving occurrence of non-uniform deformation and of dead zone.

Broadly, the present invention provides a method in which a cylindrical billet made of a polycrystalline Mn-Al-C alloy magnet which is rendered anisotropic is subjected to compressive working along the axis of the cylindrical billet at a temperature ranging from 530° to 830° C. so that the billet is plastically deformed uniformly in radial directions. As a result, a portion where compressed is converted from an initial anisotropic structure into an anisotropic structure having a direction of easy magnetization along radial directions, i.e. a radially anisotropic structure. The compressed portion may be an entire portion of the cylindrical billet or may be a circumferential portion of the billet. In the latter case, the cylindrical billet may be either hollow or solid whereas the cylindrical billet is hollow in the former case in the practice of the invention.

The polycrystalline Mn-Al-C alloy magnets which are rendered anisotropic can be obtained by subjecting known Mn-Al-C alloys for magnets to known warm plastic deformation.

By the compressive working in an axial direction of the billet, the compressed portion undergoes plastic deformation in radial directions. That is, the compressed portion is plastically deformed in radial directions and is thus rendered radially anisotropic.

According to one embodiment of the invention, the cylindrical billet is entirely compressed or plastically deformed entirely with respect its section. In this case, the billet should be hollow. The billet after completion of the compressive working is a radially anisotropic magnet. Much higher magnetic characteristics in radial directions can be obtained in very small compressive strains than those attained by any known compressive working techniques.

According to another embodiment of the invention, the cylindrical billet is compressed locally along its circumference and a portion where compressed is changed into an anisotropic structure having a direction of easy magnetization in radial directions. In this case, the billet may be either hollow or solid. Portions which undergo no compressive working have an initial anisotropic structure prior to the compressive working.

For instance, where a billet prior to compressive working is a plane-anisotropic magnet and is intended to be magnetized along the inner circumference as shown in FIG. 3, only the inner circumferential portion where magnetic paths run almost along radial directions should be subjected to compressive working. By this, the portion is rendered more radially anisotropic, thereby improving the surface magnetic flux density when magnetized along the inner circumference. The billet obtained after the compressive working has two structures, i.e. radially anisotropic and plane-anisotropic structures.

Alternatively, when a billet prior to compressive working is uniaxially anisotropic and is used for outer circumferential magnetization as shown in FIG. 2, the inner circumferential portion of the billet (where no magnetic paths run) is left uniaxially anisotropic. The resulting magnet is useful in detection of revolutions such as of motors.

Still alternatively, when a billet prior to compressive working is tangentially anisotropic and is used for inner circumferential magnetization as shown in FIG. 3, only the inner circumferential portion where magnetic paths run approximately radially are compressed. The compressed portion is rendered radially anisotropic. Thus, there can be obtained a magnet which has the tangentially anisotropic portion and the radially anisotropic portion and is suitable for inner circumferential magnetization.

It will be noted that whether a compressed or plastically deformed portion is entire or local should be determined depending on whether or not the entire section of billet is compressed or plastically deformed.

The manner of compressing or plastically deforming an entirety of a hollow cylindrical billet is described.

According to one enbodiment of the invention, a hollow cylindrical billet which is made of a polycrystalline Mn-Al-C alloy magnet rendered anisotropic is axially compressed at a temperature of 530° to 830° C. in such a state that the outer circumferential surface of the billet is held restrained while leaving at least a part of the inner circumferential surface free or non-restrictive.

Polycrystalline Mn-Al-C alloy magnets which are rendered anisotropic can be obtained by subjecting to plastic working such as extrusion at a temperature of 530° to 830° C. known Mn-Al-C alloys for magnets which are composed, for example, of 68 to 73 wt% of Mn, (1/10Mn—6.6) to (⅓Mn—22.2) wt% of C and the balance of Al. Typical of the just-mentioned magnets are a uniaxially anisotropic magnet which is obtained by extrusion used as the plastic working and has a direction of easy magnetization along the extrusion direction, and the afore-described plane-anisotropic and tangentially anisotropic magnets. The anisotropic polycrystalline Mn-Al-C alloy magnet is shaped into a hollow billet. This billet is subjected to compressive working along the axis thereof in such a state that the billet is held restrained at the outer circumference thereof and at least a part of the inner circumference is left free thereby permitting the free portion to be plastically deformed inwardly and radially. The resulting magnet has high magnetic characteristics in the radial directions. When the hollow billet in which at least a part of the inner surface is set free is compressed in the axial direction while restraining the billet at the outer surface, the at least a part is plastically deformed inwardly and radially so that the cavity portion is reduced in sectional area. The compression strain in the axial direction may be imparted inwardly radially until no cavity is present. In this case, the billet is substantially solid after the compression working. As a matter of course, after a predetermined degree of compressive strain has once been imparted to the hollow billet, the inner circumference may be restrained such as by insertion of a die into the hollow billet in order to shape the billet along the inner circumference.

It will be noted that the anisotropy of a magnet billet may vary depending on the degree of compressive working, e.g. when a tangentially anisotropic polycrystalline Mn-Al-C alloy magnet is axially compressed, its anisotropy changes to radial anisotropy through plane-anisotropy. Accordingly, proper control of the compressive working on a portion of the tangentially anisotropic magnet along its axis may result in a magnet having a tangentially anisotropic portion and a plane-anisotropic portion.

When a billet is made of a polycrystalline Mn-Al-C alloy magnet having a direction of easy magnetization along its axis (i.e. uniaxially anisotropic magnet), the compressive strain should be 0.05 or more as expressed by an absolute value of logarithmic strain. As described in detail in examples, this is because a billet prior to plastic working is rendered anisotropic in a direction along which compressive strain is imparted and thus a compressive strain of at least 0.05 is necessary for changing the billet into a structure showing high magnetic charcteristics in radial directions.

A prior art technique is known in which a uniaxially anisotropic square pillar magnet is subjected to warm compressive working in axial directions. This is intended to change the direction of easy magnetization from one direction to another direction vertical to the one direction. Accordingly, the square pillar magnet still remains uniaxially anisotropic even after the compressive working. In addition, the change of the direction of easy magnetization in another direction by the prior art technique needs a working rate of over about 60 to 70% which corresponds to a value as high as about 0.9 to 1.2 calculated as an absolute value of logarithmic strain.

Where a billet is made of a plane-anisotropic magnet, it exhibits, prior to plastic working, high magnetic characteristics in all directions within a plane including radial and tangential directions. When the billet is compressively worked along its axis while restraining the outer surface and setting free at least a part of the inner surface along the circumference of the hollow billet, it is plastically deformed at the free portion inwardly and radially. By this, the resulting magnetic exhibits high magnetic characteristics in radial directions.

The compressive working is not necessarily needed to be effected continuously but may be carried out as separated in several times. A billet which has once compressively worked may be subjected at a portion thereof to further compressive working along its axis. The further compressed portion will have higher magnetic characteristics in radial directions. This further compressive working may be effected in several times, not continuously.

Figure 4B:
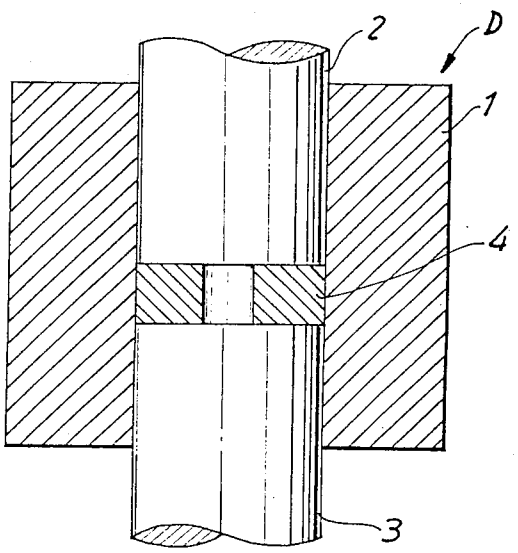
FIGS. 4(*a*) and 4(*b*) are, respectively, cross-sectional views of part of a die illustrating compressive working according to one embodiment of the invention.
Figure 4A:
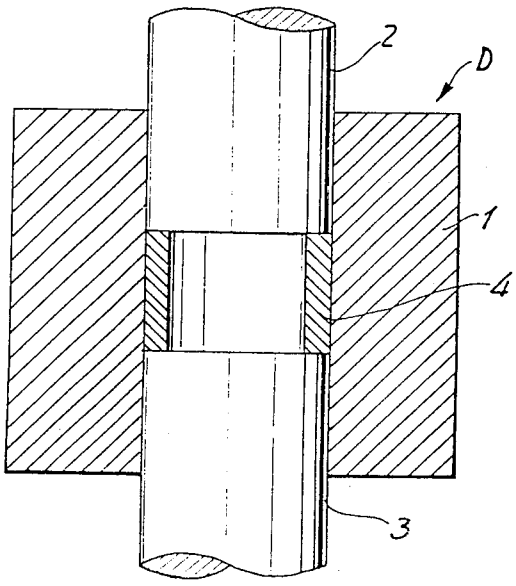

An example of the compressive working is illustrated using a billet of the cylindrical with reference to FIGS. 4(*a*) and 4(*b*). It will be noted here that like parts are designated by like reference numerals throughout the specification.

In FIG. 4(*a*) there is shown part of a die D which inludes a ring or outside die 1 and a pair of punches 2, 3. In the cavity of the ring die 1 is placed a hollow cylindrical billet 4 prior to compressive working. As shown, the billet 4 is restrained at the outer circumferential surface thereof by means of the ring die 1 by which the billet suffers little or no change in outer diameter prior to and after the working. As a matter of course, in order to allow the billet to be readily inserted into the cavity, a suitable clearance between the billet 4 and the ring die 1 may be permitted. The billet 4 is not restrained at the inner circumferential surface thereof by the die and can be plastically deformed inwardly and radially. After the billet 4 has once been compressed and imparted with a predetermined degree of compressive strain, a core (not shown) may be inserted into the hollow cylinder of the billet so as to shape the inner circumference of the billet. In order to effect the compressive working, it is sufficient that at least a part of the inner surface is set free preferably along the axis thereof, by which the free portion can plastically uniformly deformed inward and radial directions. As described before, when the hollow cylindrical billet is made of a polycrystalline Mn-Al-C alloy magnet having the direction of easy magnetization along its axis, it should be compressed to a level of compressive strain of 0.05 or higher as expressed by an absolute value of logarithmic strain. If it is intended to leave a circumferential portion of the billet uniaxially anisotropic, the inner surface of the circumferential portion is restrained such as by insertion of a core. In this state, the billet is compressed thereby leaving the restrained inner portion free of any compressive strains produced in the axial direction.

When the billet is axially compressed by the use of the punches 2, 3, it is plastically deformed inwardly and radially in a uniform manner as particularly shown in FIG. 4(*b*).

According to another embodiment of the invention, the hollow cylindrical billet is subjected to free compressive working in an axial direction thereof at a temperature of 530° to 830° C. That is, the compressive working is effected in a state that at least parts of both the inner and outer circumferences are set free or in a non-restrained state.

In this case, when the billet is made of a uniaxially anisotropic magnet, the compressive working is effected so that a compressive strain is 0.05 or higher as expressed by an absolute value of logarithmic strain for the reason described with respect to the first embodiment.

Figures 5A, 5B, 5C:
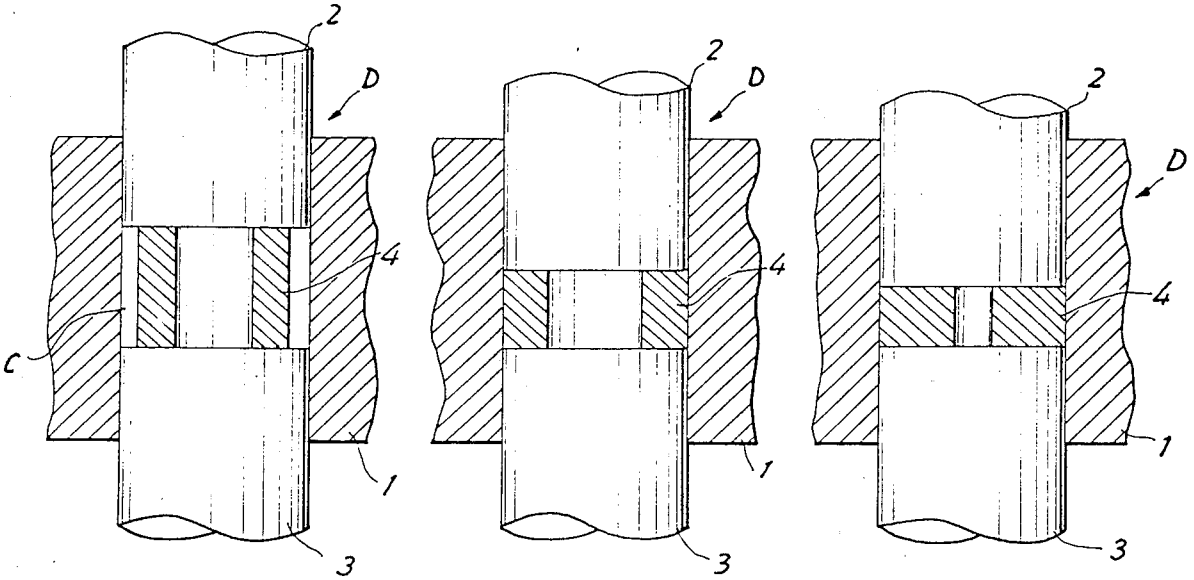
FIGS. 5(*a*), 5(*b*) and 5(*c*) through FIGS. 7(*a*) and 7(*b*) are similar to FIGS. 4(*a*) and 4(*b*) and illustrate further embodiments of the invention, respectively.

This free compressive working is particularly illustrated with reference to FIGS. 5(*a*) and 5(*b*). The hollow cylindrical billet 4 is is placed in a cavity C in such a state that it can be plastically deformed in radial directions both inwardly and outwardly. That is, inner and outer circumferential surfaces are set free without being restrained by dies. In this state, when the billet is freely compressed by means of the punches 2 and 3, the radius of the billet increases until the outer surface of the billet comes into contact with the inner wall of the ring die 4 as shown in FIG. 5(*b*). In FIGS. 5(*a*) and 5(*b*), the free compressive working is effected while setting all the outer and inner circumferential surfaces free. If it is desirable that part of a final magnet has an anisotropy or a direction of easy magnetization prior to the plastic working of the invention, the part of the billet should be restrained at the outer and inner circumferences so that it undergoes no axially compressive strain. The freely compressed billet of FIG. 5(*b*) may be further compressed while restraining the outer periphery thereof as shown in FIG. 5(*c*). The resulting magnet exhibits higher magnetic characteristics in radial directions than the magnet of FIG. 5(*b*). In the case of FIG. 5(*c*), an amount of compressive strain should be determined as follows. When an amount of compressive strain produced on the free compressive working is given as $\xi zf$ and an amount of compressive strain produced under restraining conditions along the outer circumference is given as $\xi zr$, the sum of $\xi zf$ and $\xi zr$ should be 0.05 or higher.

By the procedures of the two embodiments described above, radially anisotropic magnets can be obtained. Upon comparing the magnets obtained by these two embodiments, magnetic characteristics in axial direction at a given level of compressive strain are higher in the magnets obtained by the first embodiment. In order to make a longer radially anisotropic magnet, the first embodiment is preferable. By the term "longer magnet" is meant a magnet of a larger ratio of $h/D_o$ in which when the magnet is cylindrical, $D_o$ represents an outer diameter and h represents a length. The procedure of the second embodiment is better than the procedure of the first embodiment with respect to readiness to working. This is because free compressive working is used in the second embodiment.

It should be noted that the difference between the second embodiment using uniaxially anisotropic magnets and a known method of making plane-anisotropic magnets resides in the shape of billet used. If a billet used is a solid body such as, for example, a solid cylinder and is subjected to free compressive working along the axis of the solid body, a plane-anisotropic magnet can be obtained. On the other hand, when a billet which is a hollow body such as, for example, a hollow cylinder and is subjected to free compressive working along the axis of the hollow body, a radially anisotropic magnet can be obtained. That is, with hollow billets, the free compressive working proceeds while plastically deforming the billet in radial and inward directions thereby reducing the capacity of the cavity in the hollow billet. Accordingly, the magnet obtained after the compressive working working has not a plane-anisotropic structure but a radially anisotropic structure.

A third embodiment of the invention is described in which a billet used is a hollow or solid body and is compressed in an axial direction so that a circumferential portion thereof is plastically deformed uniformly in radial directions. The circumferential portion may be either an outer or inner portion of the billet.

Figure 6B:
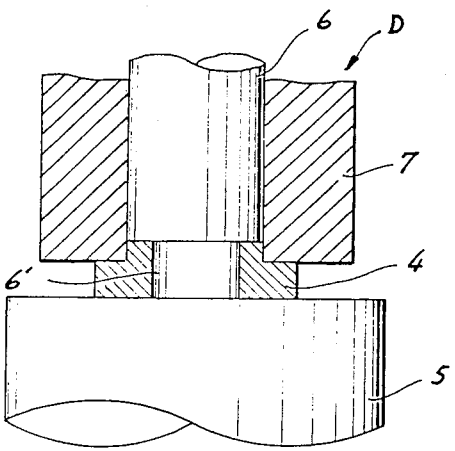
Figure 6A:
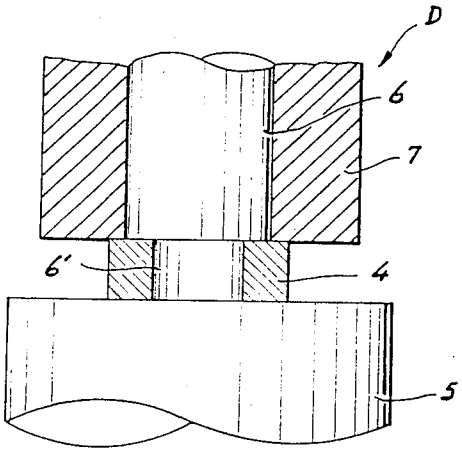

The compressive working on a portion of a billet is particularly described with reference FIG. 6(*a*) and 6(*b*). In FIG. 6(*a*), the die D includes an under die 5, a fixed punch 6 having a core 6' through which a hollow billet 4 is set, and a movable working punch 7. The billet 4 is fixed and restrained using the fixed punch 6 and the under die 5. The fixed punch 6 is so designed that an upper side of the billet 4 is partially covered or protected therewith as shown. When the working die 7 is moved downwards, an outer circumferential portion of the billet 4 is compressed along its axis and plastically deformed outwardly in radial directions as shown in FIG. 6(*b*).

Figure 7B:
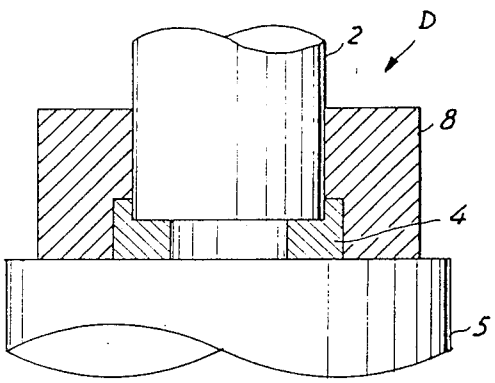
Figure 7A:
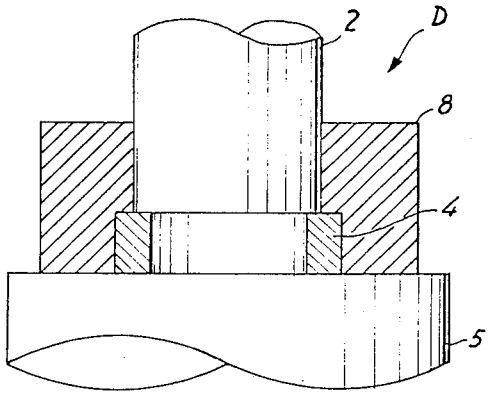

In order to plastically deform the hollow cylindrical billet at the inner circumferential portion thereof, another type of die is used as shown in FIG. 7(*a*) and 7(*b*). In the figures, the hollow billet 4 is fixed and restrained entirely at the outer surface thereof while leaving the inner surface non-restrictive. The punch 2 partially contacts with the billet 4 at the inner circumferential portion. When the punch 2 is moved downwards, the circumferential portion of the billet 4 is compressed along its axis as shown in FIG. 7(*b*).

By these compressive workings, there can be obtained permanent magnets having such anisotropic structures suitable for the afore-described outer or inner circumferential magnetization.

For example, when a tangentially anisotropic magnet is used as the billet, the compressive working at the outer or inner circumferential portion results in a magnet having directions of easy magnetization along its radius. That is, the magnet has the radially anisotropic portion which undergoes the compressive working and the original tangentially anisotropic portion.

The procedures of the third embodiment may be applied to a billet which has once been compressed in an axial direction as shown in FIGS. 5(*b*) and 5(*c*). When the magnets of FIGS. 5(*b*) and 5(*c*) are further compressed in an axial direction as shown in FIGS. 6(*a*) and 6(*b*) or 7(*a*) and (7*b*), the inner or outer circumferential portion of the magnet can be plastically deformed radially and have higher magnetic characteristics in the axial direction than the non-compressed portion.

In any embodiments described above, the compressive working is not necessarily needed to be effected continuously but may be effected stepwise in two or more times until a desired level of compressive strain is attained.

In the foregoing description, the compressive working of billet can be broadly divided into an entire working (first and second embodiments) and a local working (third embodiment). When a change in outer or inner circumferential length of a billet is taken into account, the method of the invention may be classified into two groups. One group involves little or no change in either of the outer and inner circumferential lengths and the other group involves changes in both the lengths.

The case where a billet is entirely plastically deformed as in the first embodiment and the case where a billet is deformed locally along the outer or inner circumferential portion correspond to the one group. This group enables a billet to be rendered more radially anisotropic. The case of the second embodiment where a billet is subjected to the free compressive working corresponds to the other group.

For instance, in the procedure illustrated in FIGS. 7(*a*) and 7(*b*), the outer length prior to and after the compressive working does not change with a change of the inner length. On the contrary, with the case shown in FIGS. 5(*a*) through 5(*c*), both the outer and inner lengths of the billet change prior to and after the compressive working.

In the foregoing, the billet is illustrated as a cylinder but may be in other forms.

As described before, the compressive working is effected at a temperature of 530° to 830° C. in the practice of the invention. However, temperatures exceeding 780° result in lowering of magnetic characteristics to an extent. Accordingly, preferable temperatures range from 560° to 760° C.

The present invention is more particularly described by way of examples.

EXAMPLE 1

Figure 8:
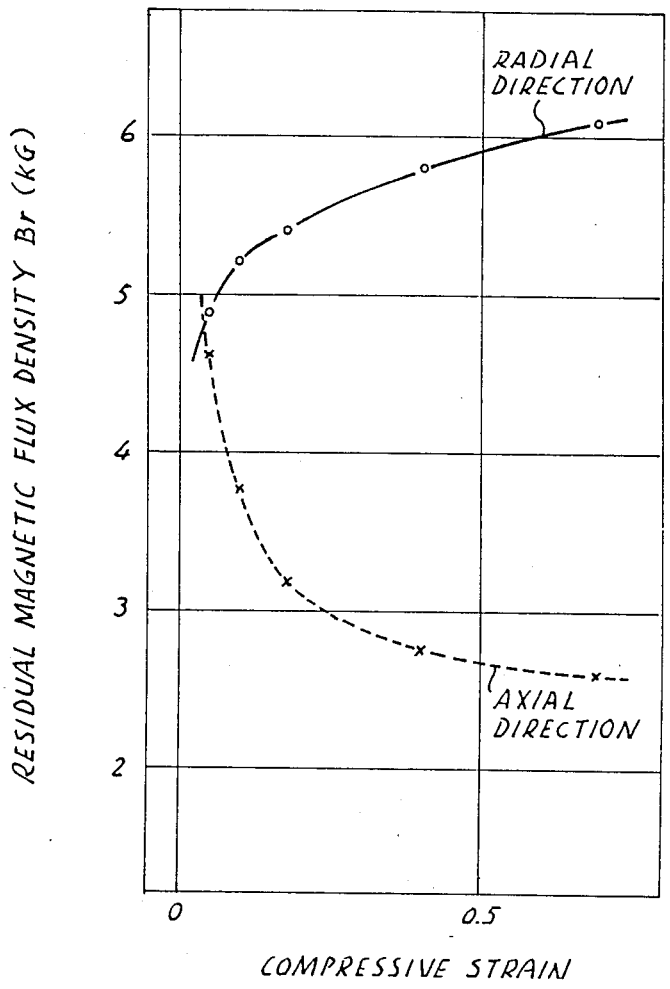
FIG. 8 is a grapical representation of residual magnetic flux density, Br, in relation to variation in compressive strain for a magnet obtained in Example 1.

A charge composition of 69.5 wt% (hereinafter referred to simply as %) of Mn, 29.3% of Al, 0.5% of C and 0.7% of Ni was melted and cast to make a solid cylindrical billet having a diameter of 70 mm and a length of 60 mm. This billet was kept at 1100° C. for 2 hours and allowed to cool down to room temperature. The billet was extruded through a lubricant at 720° C. to a diameter of 45 mm, followed by further extrusion through a lubricant at a temperature of 680° C. to a diameter of 31 mm. The extruded rod was cut into pieces having a length of 20 mm. The pieces were machined to obtain several hollow cylindrical billets each having an outer diameter of 30 mm and an inner diameter of 15 to 24 mm. The billets were placed in a die of the type shown in FIG. 4(*a*) and compressed at different strains at a temperature of 680° C. while restraining the outer circumferential surface but setting the inner circumferential surface free. In FIG. 4, the ring die 1 had an inner diameter of 30 mm. From the compressed billets were cut cubic samples having each side of about 4 mm, followed by measurement of magnetic characteristics in which the respective sides of each cube were arranged parallel to axial, radial and tangential directions. The variation of residual magnetic flux density, Br, in relation to compressive strain $\xi z$ is shown in FIG. 8. As will be seen from FIG. 8, when $\xi z$ is 0.05, the residual magnetic flux density is much greater in the radial direction than in the axial direction. Higher values of the compressive strain result in higher flux density in the radial direction.

Moreover, the results shown in FIG. 8 reveal that a change of the direaction of easy magnetization from axially to radially is sharp in the range of $\xi z$ up to 0.05. Upon comparing with known compressive working techniques, higher magnetic characteristics can be obtained in very small compressive strains.

In other words, in order to obtain high magnetic characteristics in radial directions by known compressive working techniques, great compressive strains are needed. However, in the practice of the invention, magnets of high magnetic characteristics can be obtained in small compressive strains.

A billet which had been compressed to $\xi z=0.69$ was machined to give a cylindrical magnet having an outer diameter of 28 mm, an inner diameter of 14 mm and a length of 10 mm, followed by 6-pole magnetization in radial directions as shown in FIG. 1. The magnetization was effected using a 2000 $\mu$F by the pulse magnetization technique at 1500 V. The magnetic flux density of the diameter of 36 mm and an inner diameter of 25 mm, followed by magnetization and measurement of a surface magnetic flux density in the same manner as described before. By the compressive working of the billet only at the inner circumferential portion thereof, the surface magnetic flux density increased by 0.2 kG.

EXAMPLE 4

The extruded rod having a diameter of 31 mm obtained in Example 1 was cut into a piece having a length of 20 mm and machined to give a hollow cylindrical billet having an outer diameter of 24 mm, an inner diameter of 12 mm and a length of 20 mm. The billet was subjected to free compressive working along its axis at a temperature of 680° C. in a manner as shown in FIGS. 5(*a*) and 5(*b*), followed by further compressive working in a manner as shown in FIGS. 5(*b*) and 5(*c*) in which the outer surface of the billet was restrained but the inner surface was not restrained so that the billet could be freely deformed inwardly. In this case, the ring die 1 of FIG. 5 had an inner diameter of 30 mm. After completion of the working, the billet had an outer diameter of 30 mm and a length of 10 mm. The billet was machined to have an outer diameter of 28 mm and an inner diameter of 14 mm and was then radially magnetized under the same conditions as in Example 3. The measurement was effected in the same manner as in Example 3.

For comparison, a plane-anisotropic magnet made in the same manner as in Example 3 was machined to have an outer diameter of 28 mm and an inner diameter of 14 mm, followed by magnetization in the same manner as described above.

The magnet obtained according to the method of the invention had a surface magnetic flux density as high as about 1.3 times the known plane-anisotropic magnet.

The magnetized hollow cylindrical magnet of the invention was subjected to further compressive working of the outer circumferential portion alone at a temperature of 680° C. using the die shown in FIGS. 6(*a*) and 6(*b*). In this case, the punch 6 had an outer diameter, i.e. an inner diameter of the punch 7, of 20 mm. After completion of the working, the billet had a length of 8 mm at the compressed portion. The worked billet was machined to have an outer diameter of 28 mm and an inner diameter of 14 mm, followed by magnetization and measurement of a surface magnetic flux density in the same manner as described above. As a result, it was found that the density increased by 0.2 kG.

EXAMPLE 5

Two plane-anisotropic magnets (i.e. solid cylindrical billets having a diameter of 42 and a length of 10 mm) made in Example 3 for comparison were machined to give a hollow cylindrical billet having an outer diameter of 30 mm, an inner diameter of 20 mm and a length of 20 mm. The billet was subjected to free compressive working along its axis through a lubricant at a temperature of 660° C. The compressed billet had a length of 10 mm. The billet was machined to give a hollow cylindrical magnet having an outer diameter of 36 mm, an inner diameter of 25 mm and a length of 10 mm, followed by inner circumferential magnetization in the same manner as in Example 3. The surface magnetic flux density was measured in the same manner as in Example 3. As a result, it was found upon comparison with the magnet of the present invention obtained in Example 3, no appreciable difference in surface magnetic flux density was recognized.

EXAMPLE 6

A charge composition of 69.5% of Mn, 29.3% of Al, 0.5% of C and 0.7% of Ni was melted and cast to give a solid cylindrical billet having a diameter of 60 mm and a length of 50 mm. The billet was kept at 100° C. for 2 hours and allowed to cool down to room temperature. The billet was extruded through a lubricant at a temperature of 720° C. to a diameter of 35 mm, followed by further extrusion through a lubricant at a temperature of 680° C. to a diameter of 24 mm. The extruded rod was cut into a piece having a length of 20 mm, followed by free compressive working through a lubricant at a temperature of 680° C. to a length of 10 mm. After the working, the billet was machined to have a diameter of 32 mm and a length of 10 mm, thereby obtaining a solid cylindrical magnet (plane-anisotropic magnet).

Figure 10A:
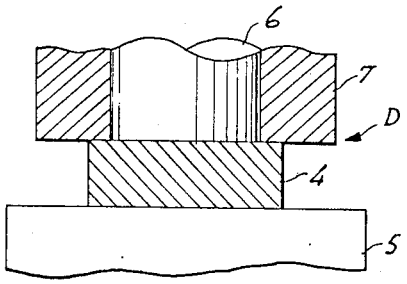
FIGS. 10(*a*) and 10(*b*) are cross-sectional views of part of a die illustrating another embodiment of the invention.
Figure 10B:
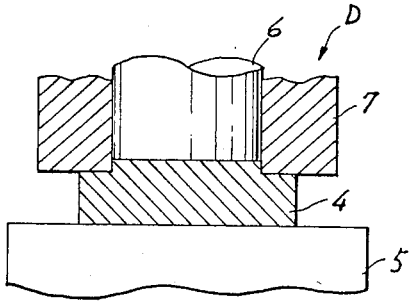

This magnet was further subjected to compressive working at its outer circumferential portion alone at a temperature of 680° C. using a die shown in FIG. 10. In the figure, the working punch 7 had an inner diameter of 25 mm, i.e. an outer diameter of the fixed punch was 25 mm. The magnet after the compressive working had the compressed outer portion with a length of 8 mm. The magnet after the working was machined in the form of a hollow cylinder having an outer diameter of 32 mm and an inner diameter of 10 mm. The hollow cylindrical magnet was magnetized at 24 poles along the compressed outer portion. The magnetization was carried out using a 2000 $\mu$F oil condenser by the pulse magnetization technique at 1500 V. The surface magnetic flux density of the outer circumferential portion was measured by the Hall element.

For comparison, a plane-anisotropic magnet made by the same procedure as described above was machined into a hollow cylinder having an outer diameter of 32 mm and inner diameter of 10 mm, followed by outer cirumferential magnetization in a manner as mentioned above.

As a result, it was found that the magnet obtained according to the method of the invention had a surface magnetic flux density as high as about 1.2 times the known plane-anisotropic magnet.

Two plane-anisotropic magnets made in the same manner as described above were machined to give hollow cylindrical magnets each having an outer diameter of 32 mm, an inner diameter of 16 mm and a length of 10 mm. One hollow cylindrical magnet was subjected to compressive working only at the inner circumferential portion thereof at a temperature of 680° C. using a die of the type shown in FIG. 7. The compressed inner portion had a length of 8 mm. The punch 2 in FIG. 7 had a diameter of 23 mm. The worked magnet was machined to give a hollow cylinder having an outer diameter of 32 mm and an inner diameter of 16 mm. The magnet of the invention and the plane-anisotropic magnet, both of which had been compressed only at the inner circumferential portion thereof, were subjected to inner circumferential magnetization of 18 poles.

As a result, it was found that the magnet obtained according to the invention had a surface magnetic flux density higher by about 1.2 times than the known plane-anisotropic magnet.

outer circumferential surface was measured by the Hall element. For comparison, the afore-indicated extruded rod having a diameter of 31 mm was cut into a piece with a length of 20 mm and machined to give a solid cylindrical billet having a diameter of 20 mm and a length of 20 mm, followed by free compressive working along the axis of the cylinder through a lubricant at a temperature of 680° C. In the case, the compressive strain was 0.69. The billet obtained after the free compressive working was a plane-anisotropic magnet. This magnet was machined to have a form of a hollow cylinder in the same manner as described above and magnetized, followed by measurement of the surface magnetic flux density.

As a result, it was found that the surface magnetic flux density of the magnet obtained according to the method of the invention had a value as high as about 1.4 times the density of the plane-anisotropic magnet.

The magnetized magnet of the invention was subjected to compressive working along the outer circumferential portion at a temperature of 680° C. using the die shown in FIGS. 6(*a*) and 6(*b*). The punch 6 had an outer diameter of 22 mm. The compressed portion had a length of 8 mm. After completion of the working, the billet was machined to give an outer diameter of 28 mm and an inner diameter of 14 mm, followed by magnetization in the same manner as described before. The magnet obtained after the local working had a surface magnetic flux density higher by 0.2 kG than the magnet prior to the local compressive working.

EXAMPLE 2

The extruded rod with a diameter of 31 mm obtained in Example 1 was cut into a 50 mm long piece and extruded through a lubricant at a temperature of 680° C. to a diameter of 22 mm. The extruded rod was cut into 20 mm long pieces and subjected to free compressive working along the axis through a lubricant at a temperature of 680° C. After the free compressive working, the billets were each machined to give a hollow cylinder having an outer diameter of 30 mm, an inner diameter of 22 mm and a length of 10 mm. Two hollow cylinders were put one on the top of another along their axis and subjected to compressive working using the die shown in FIGS. 4(*a*) and 4(*b*) at a temperature of 680° C. while restraining the outer circumference of each cylinder with the inner circumference being non-restrictive. The worked billet had a length of 10 mm and machined in the same manner as in Example 1, followed by magnetization and measurement of its surface magnetic flux density. Similar results as with the magnet obtained in Example 1 prior to the local compressive working were obtained.

EXAMPLE 3

The extruded rod obtained in Example 1 was cut into pieces with a length of 20 mm and machined to give several hollow cylindrical billets each having an outer diameter of 30 mm, an inner diameter of 20 mm and a length of 20 mm.

Figure 9:
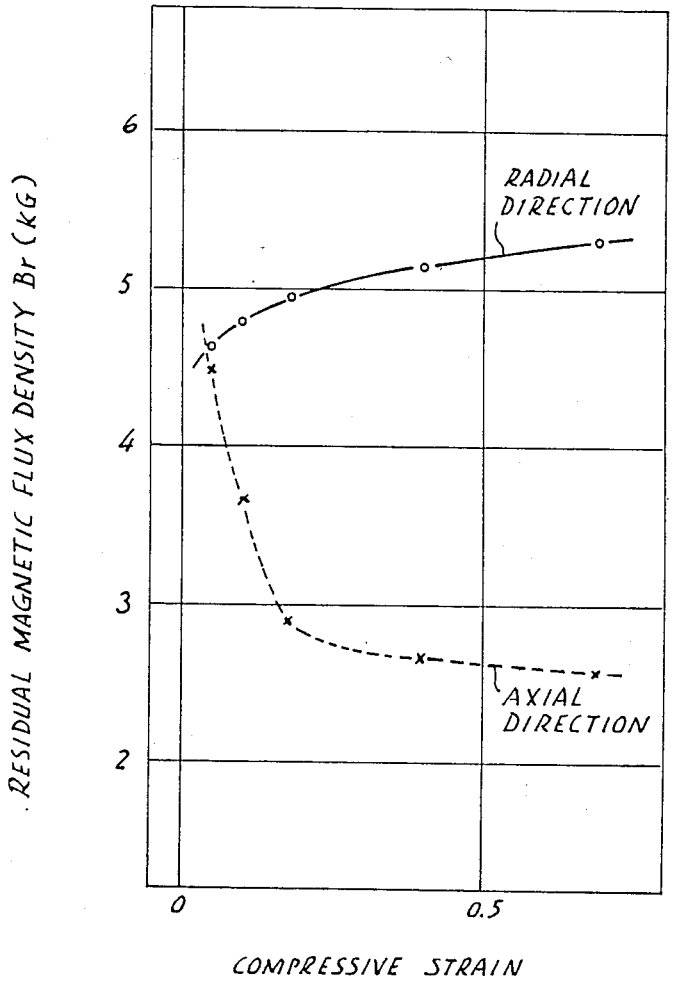
FIG. 9 is similar to FIG. 8 for a different type of magnet obtained in Example 3.

These billets were subjected to free compressive working along the axis thereof through a lubricant at a temperature of 680° C. at different strains. A cubic sample having each side of about 4 mm was cut off from each billet obtained after the working and subjected to measurement of magnetic charcteristics. The measurement was effected such that the respective sides of the sample were parallel to axial, radial and tangential directions. In FIG. 9, there is shown a compressive strain ($\xi z$) in relation to residual magnetic flux (Br) for different directions.

As is seen from FIG. 9, when the compressive strain is 0.05, the residual magnetic flux density becomes greater in the radial direction than in the axial direction. A greater compressive strain results in a greater residual magnetic flux density in the radial direction. Furthermore, a change of the direction of easy magnetization from axial to radial directions becomes sharp within a range of $\xi z$ up to 0.05. Upon comparing with magnets obtained by known compressive workings, the magnets obtained according to the present invention exhibit high magnetic characteristics in much smaller compressive strains.

The billet was further compressed as shown in FIG. 5(*c*) to have a compressive strain of 0.69 and machined to give a hollow cylindrical magnet having an outer diameter of 36 mm, an inner diameter of 25 mm and a length of 10 mm. The magnet was subjected to inner circumferential magnetization of 18 poles as shown in FIG. 3. The magnetization was effected using a 2000 $\mu$F oil condenser by a pulse magnetization technique at 1500 V. The surface magnetic flux density of the inner magnetized portion was measured by the Hall element.

For comparison, the afore-indicated extruded rod having a diameter of 31 mm was cut into a piece with a length of 20 mm and machined to give a solid cylindrical billet having a diameter of 30 mm and a length of 20 mm. The billet was subjected to free compessive working along its axis through a lubricant at a temperature of 680° C. so that it was imparted with a compressive strain ($\xi z$) of 0.69. The compressed billet was a plane-anisotropic magnet. The magnet was machined in the same manner as described above to obtain a hollow cylindrical magnet, followed by inner circumferential magnetization and measurement of a surface magnetic flux density.

As a result, it was found that the magnet obtained according to the invention had a surface magnetic flux density as high as about 1.2 times the known plane-anisotropic magnet.

Upon the free compressive working in the axial direction of the hollow cylindrical billet having an outer diameter of 30 mm, an inner diameter of 20 mm and a length of 20 mm, the billet was first compressed to a compressive strain of 0.41. Then, the plastic working was stopped for 15 seconds and then the compressed billet was subjected to further free compressive working at a temperature of 680° C. so that a compressive strain reached 0.69 in total. After completion of the compressive working, the billet was machined in the same manner as described before to give a hollow cylinder. The hollow cylindrical magnet was magnetized at the inner circumferential portion and its surface magnetic flux density was measured in the same manner as described. As a result it was found that the density increased by 0.2 kG as compared with the case where the free compressive working was continuously effected.

Moreover, the hollow cylindrical magnet which had been subjected to the continuous free compressive working and magnetized was further subjected to compressive working of the inner circumferential portion thereof using the die shown in FIG. 7. In this case, the punch 2 had a diameter of 30 mm. After the compressive working, the compressed portion had a length of 8 mm. The resulting billet was machined to have an inner

EXAMPLE 7

The extruded rod with a diameter of 31 mm obtained in Example 1 was cut into pieces having a length of 20 mm, followed by machining into hollow cylinders having an outer diameter of 31 mm, an inner diameter of 10 to 22 mm and a length of 20 mm. These billets were subjected to compressive working only at the inner circumferential portion thereof at a temperature of 680° C. using a die of the type shown in FIG. 7. In FIG. 7, the punch 2 had an outer diameter of 25 mm.

Figure 11:
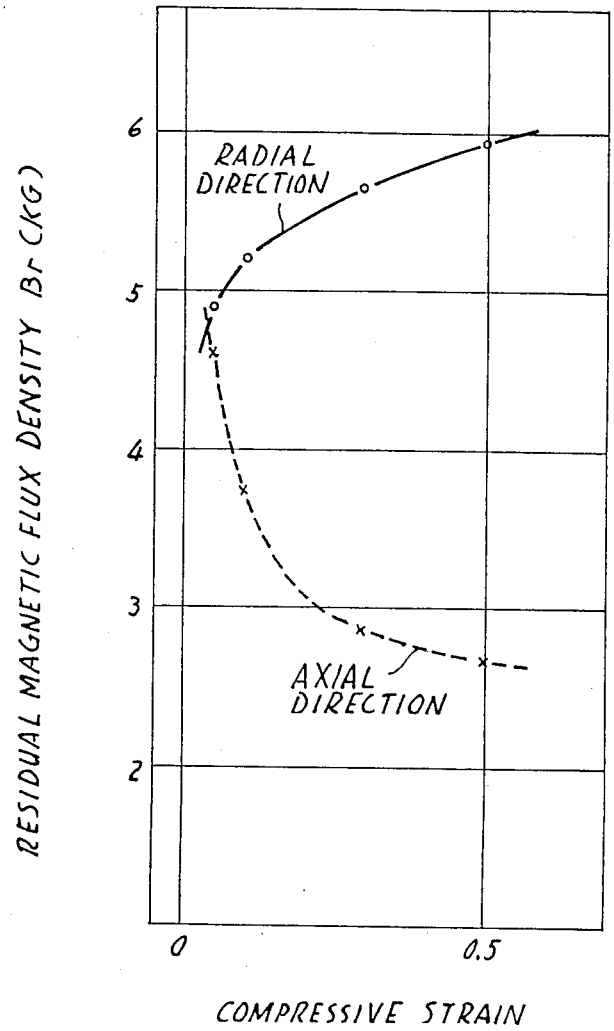
FIG. 11 is a graphical representation of residual magnetic flux density, Br, in relation to variation in compressive strain for a magnet obtained in Example 7.

A cubic sample having each side of about 5 mm was cut off from the compressed portion of the worked billet and its magnetic characteristics were measured. In the measurement, the cube was set so that the respective sides thereof were parallel to the axial, radial and tangential directions. The variation of residual magnetic flux density, Br, in relation to compressive strain, $\xi z$, is shown in FIG. 11. When the compressive strain is 0.05, the flux density becomes greater in the radial direction than in the axial direction. A greater compressive strain results in a greater flux density in the radial direction. Furthermore, a change of the direction of easy magnetization from axial to radial directions sharply proceeds within a range of $\xi z$ up to 0.05. High magnetic characteristics can be obtained in very small strains.

The extruded rod having a diameter of 31 mm as used above was cut into a piece with a length of 20 mm, followed by compressive working only at the outer circumferential portion thereof at a temperature of 680° C. using a die of the type shown in FIG. 10. In this case, the inner diameter of the punch 7 was 14 mm. From the compressed portion of the billet was cut off a cubic sample having each side of about 5 mm, followed by measurement of its magnetic charcteristics.

Upon comparing with the magnet obtained in the former part of this example and compressed to the same degree of Ez, no substantial difference was recognized.

EXAMPLE 8

A charge composition of 69.5% of Mn, 29.3% of Al, 0.5% of C and 0.7% of Ni was melted and cast to give a solid cylindrical billet having a diameter of 80 mm and a length of 60 mm. The billet was kept at 1100° C. for 2 hours, followed by allowing to cool to room temperature. The billet was extruded through a lubricant at a temperature of 720° C. to a diameter of 45 mm, followed by further extrusion through a lubricant at a temperature of 680° C. to a diameter of 31 mm. The extruded rod was machined to give a hollow cylinder having an outer diameter of 30 mm, an inner diameter of 10 mm and a length of 20 mm.

Figure 12A:
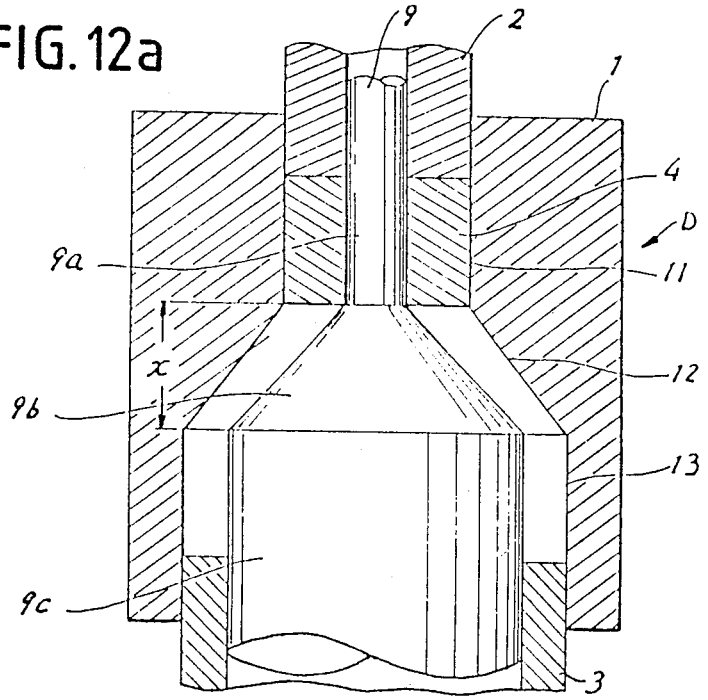
FIGS. 12(*a*) and 12(*b*) are sectional views of a part of a die used in Examples 8 and 9.
Figure 12B:
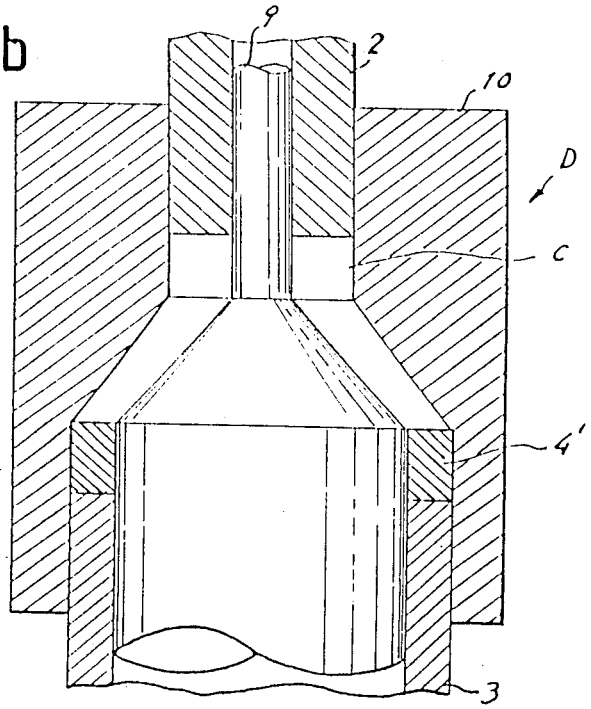

The hollow cylindrical billet was extruded through a lubricant at a temperature of 680° C. using a die of the type shown in FIGS. 12(*a*) and 12(*b*). FIG. 12(*a*) show a state prior to the extrusion and FIG. 12(*b*) shows a state after the extrusion. In FIGS. 12(*a*) and 12(*b*), there is shown a die D which has a core 9 having a small-size section 9*a*, a frustoconical section 9*b* and a large-size section 9*c* and a ring die 1 surrounding the core 9. Between the core and the ring die is established a cavity C having a container portion 11, a intermediate portion 12 and a bearing portion 13. In this example, the container portion had an outer diameter of 30 mm and an inner diameter of 10 mm. The bearing portion 13 had an outer diameter of 63.2 mm and an inner diameter of 49 mm. The length of the intermediate portion along the axis of the billet was 40 mm. After completion of the extrusion, the billet had an outer diameter of 63.2 mm, an inner diameter of 49 mm and a length of 10 mm.

The thus extruded billet was subjected to compressive working along its axis only at the outer circumferential portion thereof at a temperature of 680° C. according to the procedure shown in FIGS. 6(*a*) and 6(*b*). That is, the billet 4 was set coaxially with the movable punch 7 and compressed only at the outer circumferential portion of the billet 4. After the compressive working, the compressed portion had a length of 8 mm and the non-compressed inner portion had a length of 10 mm. The billet was machined to have an outer diameter of 62 mm and an inner diameter of 50 mm and magnetized at 30 poles along the outer circumference. The magnetization was effected using a 2000 $\mu$F oil condenser by the pulse magnetization technique at 1500 V. The surface magnetic flux density was measured by the use of the Hall element.

In the same manner as in the above procedure, there was made a hollow cylindrical magnet having an outer diameter of 62 mm, an inner diameter of 50 mm and lengths of 8 mm at the outer circumferential portion and 10 mm at the inner circumferential portion. From the outer and inner circumferential portions of the magnet were, respectively, cut off three rectangular parallelopipeds (six in total) so that the respective sides were parallel to radial (r direction), tangential ($\theta$ direction) and axial directions. The side parallel to the axial direction was 2 mm, the side parallel to the tangential direction was 4 mm and the side parallel to the axial direction was 5 mm. The three rectangular parallelopipeds were put one on the top of another to form a rectangular parallelopiped having sides of 6 mm, 4 mm and 5 mm. This sample was subjected to measurement of magnetic characteristics in the respective directions.

As a result, it was found that as for the inner circumferential portion, Br=5.9 kG, Hc=2.7 kOe and (BH)max=6.2 MG.Oe in the tangential direction, Br=3.1 kG, Hc=2.3 kOe and (BH)max=2.0 in the radial direction, and Br=2.6 kG, Hc=1.9 kOe and (BH)max=1.4 MG.Oe in the axial direction. With regard to the outer circumferential portion, Br=3.0 kG, Hc=1.9 kOe and (BH)max=1.4 MG.Oe in the tangential direction, Br=5.6 kG, Hc=2.5 kOe and (BH)max=5.4 MG.Oe in the axial direction, and Br=2.6 kG, Hc=1.9 kOe and (BH)max=1.4 MG.Oe in the axial direction.

As will be understood from the above results, the magnet is an anisotropic magnet of the type which is suitable for outer circumferential magnetization. The inner circumferential portion is rendered tangentially anisotropic and the outer circumferential portion is rendered radially anisotropic.

For comparison, the extruded rod with a diameter of 45 mm as used above was cut into a 20 mm long piece to give a solid cylindrical billet having a diameter of 45 mm and a length of 20 mm. Thereafter, the solid cylindrical billet was subjected to free compressive working through a lubricant along the axis thereof at a temperature of 680° C. After the working, the billet had a length of 10 mm. This billet was a plane-anisotropic magnet and was machined to give a hollow cylinder having an outer diameter of 62 mm and an inner diameter of 50 mm, followed by magnetization and measurement in the same manner as described above.

From the plane-anisotropic magnet at a diameter of about 55 mm was cut off a cubic sample having each side of 5 mm so that the respective sides were parallel to radial, tangential and axial directions. The cubic sample was subjected to measurement of magnetic characteristics. The magnetic characteristics were as follows: Br=4.6 kG, Hc=2.8 kOe and (BH)max=4.0 MG.Oe in the radial and tangential directions; and Br=2.6 kG, Hc=2.0 kOe and (BH)max=1.4 MG.Oe in the axial direction.

The permanent magnet of the invention had a surface magnetic flux density as high as about 1.4 times the known plane-anisotropic magnet and was thus very excellent for outer circumferential magnetization.

EXAMPLE 9

The extruded rod obtained in Example 8 was cut into a 20 mm long piece and machined to give a hollow cylindrical billet having an outer diameter of 30 mm, an inner diameter of 10 mm and a length of 20 mm similar to Example 8.

The hollow cylindrical billet was extruded in the same manner as in Example 8 using such a die as shown in FIG. 12 to obtain a billet having an outer diameter of 63.2 mm, an inner diameter of 49 mm and a length of 10 mm. The billet was further subjected to compressive working only at the outer circumferential portion thereof along the axis at a temperature of 680° C. using a die as shown in FIG. 7(*a*) and 7(*b*). That is, the billet was fixed using the restrictive die 8 and the under die 5 and the billet 4 was set substantially coaxially with the punch 2, followed by comprerssive working.

The punch 2 had a diameter of 56 mm and after the working, the billet had a length of 8 mm at the compressed inner portion and a length of 10 mm at the outer portion.

The billet was machined to have an outer diameter of 62 mm and an inner diameter of 50 mm and magnetized at the inner circumferential portion thereof at 30 poles by the pulse magnetization technique at 1500 V using a 2000 μF oil condenser. The surface magnetic flux density of the inner circumferential portion was measured by the Hall element.

In a manner similar to the above procedure, there was made a hollow cylindrical magnet having an outer diameter of 62 mm, an inner diameter of 50 mm and lengths of 8 mm at the inner portion and 10 mm at the outer portion. From the inner and outer portions were, respectively, cut off three rectangular parallelopipeds (six in total) so that the respective sides were parallel to radial (r direction), tangential ($\theta$) and axial directions. The side parallel to the radial direction was 2 mm, the side parallel to the tangential direction was 4 mm, and the side parallel to the axial direction was 5 mm. The three parallelopipeds were put one on the top of another to give a rectangular parallelopiped having sides of 6 mm, 4 mm and 5 mm, followed by measuring magnetic characteristics in the respective directions. As for the outer circumferential portion, Br=5.9 kG, Hc=2.7 kOr and (BH)max=6.2 MG.Oe in the tangential direction, Br=3.1 kG, Hc=2.3 kOe and (BH)max=6.2 MG.Oe in the radial direction, and Br=2.6 kG, Hc=1.9 kOe and (BH)max=1.4 MG.Oe in the axial direction. With regard to the inner circumferential portion, Br=3.0 kG, Hc=2.0 kOe and (BH)max=1.7 MG.Oe in the tangential direction, Br=5.6 kG, Hc=2.5 kOe and (BH)max=5.4 MG.Oe in the radial direction, and Br=2.6 kG, Hc=1.9 kOe and (BH)max=1.4 MG.Oe in the axial direction.

As will be seen from the above, the magnet is tangentially anisotropic in the outer portion and is radially anisotropic in the inner portion.

For comparison, the extruded rod with a diameter of 45 mm used above was cut into a 20 mm long piece and machined to give a solid cylinder having a diameter of 45 mm. This solid cylindrical billet was subjected to free compressive working through a lubricant along the axis thereof at a temperature of 680° C. The compressed billet had a length of 10 mm and was plane-anisotropic. The billet was machined to give a hollow cylinder having an outer diameter of 62 mm and an inner diameter of 50 mm, followed by magnetization and measurement in the same manner as described before.

The plane-anisotropic magnet obtained in the same manner as described above was cut off at a portion of about 55 mm in diameter to give a cube having each side of 5 mm. The respective sides were made parallel to radial, tangential and axial directions. The cubic sample was subjected to measurement of magnetic characteristics. The characteristics were as follows: Br=4.6 kG, Hc=2.8 kOe and (BH)max=4.0 MG.Oe in the radial and tangential directions and Br=2.6 kG, Hc=2.0 kOe and (BH)max=1.4 MG.Oe in the axial direction.

The permanent magnet of the invention had a surface magnetic flux density as high as about 1.4 times the plane-anisotropic magnet and was thus very excellent for inner circumferential magnetization.

What is claimed is:

1. A permanent magnet consisting essentially of a polycrystalline Mn-Al-C alloy having a compressed circumferential portion and a noncompressed portion and having been produced by providing a cylindrical billet of a polycrystalline Mn-Al-C alloy magnet which has been rendered anisotropic, and subjecting said cylindrical billet to compressive working on only a circumferential portion thereof in such a way that the compressive working is applied to said circumferential portion parallel to the axis thereof at a temperature of 530° to 830° C. until a compressive strain produced by the compressive working is at least 0.05 as expressed by the absolute value of logarithmic strain and said cylindrical billet is plastically deformed uniformly in the radial direction, the anisotropy of said compressed circumferential portion being radial wherein the only direction of easy magnetization of said compressed circumferential portion is parallel to the radial axis and the anisotropy of the noncompressed portion being different from that of said compressed portion and selected from the group consisting of tangential, uniaxial and plane anisotropy.

2. The magnet according to claim 1, wherein said cylindrical billet is solid and said circumferential portion is an outer circumferential portion and said outer circumferential portion is plastically deformed uniformly in the radial direction and has said direction of easy magnetization parallel to the radial axis.

3. The magnet according to claim 1, wherein said cylindrical billet is hollow and the compressive working is applied to an inner circumferential portion of said billet parallel the axis of said billet and the inner circumferential portion is plastically deformed uniformly in the radial direction.

4. The magnet according to claim 1, wherein said cylindrical billet is hollow and the compressive working is applied to an outer circumferential portion of said billet parallel to the axis of said billet and the inner circumferential portion is plastically deformed uniformly in the radial direction.

5. The magnet according to claim 1, wherein said billet is initially a polycrystalline Mn-Al-C alloy magnet having a direction of easy magnetization parallel to the axis of said magnet.

6. A magnet according to claim 1, wherein said billet is initially a polycrystalline Mn-Al-C alloy magnet which has a direction of easy magnetization parallel to a plane which is at right angles with respect to the axial direction of said billet and is magnetically isotropic within the plane.

7. A magnet according to claim 1, wherein said billet is initially a polycrystalline Mn-Al-C alloy magnet having a direction of easy magnetization along the tangential direction of said billet.

8. A magnet according to claim 1, wherein the compressive working temperature is in the range of 560° to 760° C.

9. A magnet according to claim 1, wherein the compressive working is applied two or more times until said compressive strain is produced in the worked portion.

10. A permanent magnet consisting essentially of a polycrystalline Mn-Al-C alloy magnet of a cylindrical form, the cylindrical magnet including a circumferential compressed portion having an anisotropic structure selected from the group consisting of radial, tangential, uniaxial and plane anisotropic structures and further including a noncompressed portion having an anisotropic structure different from that of said compressed portion and selected from the group consisting of radial, tangential, uniaxial and plane anisotropic structures.

11. A permanent magnet according to claim 10, wherein said circumferential compressed portion has a radially anisotropic structure and the noncompressed portion has a tangentially anisotropic structure.

12. A permanent magnet according to claim 10, wherein said circumferential compressed portion has a radially anisotropic structure and the noncompressed portion has a plane-anisotropic structure.

13. A permanent magnet according to claim 10, wherein said circumferential compressed portion has a plane-anisotropic structure and the noncompressed portion has a tangentially anisotropic structure.

14. A permanent magnet according to claim 10, wherein the cylindrical magnet is hollow or solid.

* * * * *